US008733962B1

(12) United States Patent
Leslie

(10) Patent No.: US 8,733,962 B1
(45) Date of Patent: May 27, 2014

(54) LIGHT REFLECTOR CONE MOUNTING APPARATUS

(71) Applicant: Howe David Leslie, Atlanta, GA (US)

(72) Inventor: Howe David Leslie, Atlanta, GA (US)

(73) Assignee: Southpac Trust International, Inc., Rarotonga (CK), Trustee of the LDH Trust ( * ) Notice: Subject to any disclaimer, the term of this patent is extended or adjusted under 35 U.S.C. 154(b) by 0 days.

(21) Appl. No.: 13/903,392

(22) Filed: May 28, 2013

Related U.S. Application Data

(63) Continuation-in-part of application No. 13/718,013, filed on Dec. 18, 2012, now Pat. No. 8,534,881, which is a continuation-in-part of application No. 13/758,222, filed on Feb. 4, 2013.

(51) Int. Cl.
*F21V 17/10* (2006.01)
*F21V 17/06* (2006.01)

(52) U.S. Cl.
CPC ..... *F21V 17/10* (2013.01); *F21V 17/06* (2013.01)
USPC ..... 362/148; 362/150; 362/433; 362/396

(58) Field of Classification Search
USPC ..... 362/147, 148, 150, 396, 404, 408, 433, 362/364, 365, 366
See application file for complete search history.

(56) References Cited

U.S. PATENT DOCUMENTS 4,763,231 A * 8/1988 Houplain ..... 362/148
6,164,802 A * 12/2000 Gromotka ..... 362/375
2010/0265725 A1* 10/2010 Wilcox ..... 362/364

* cited by examiner

*Primary Examiner* — Laura Tso
(74) *Attorney, Agent, or Firm* — Troutman Sanders LLP; James E. Schutz; Mark Lehi Jones

(57) ABSTRACT

One example implementation of the disclosed technology is directed to a light reflector cone mounting apparatus that is configured to attach to a light reflector trim, and comprises an outer perimeter edge configured with two or more perimeter clip mounting features. Perimeter clips can be engaged in each of the two or more perimeter clip mounting features, wherein each perimeter clip is configured to engage between the light reflector trim and a ceiling surface, thereby attaching the light reflector cone mounting apparatus to the light reflector trim.

17 Claims, 6 Drawing Sheets

FIG 1C
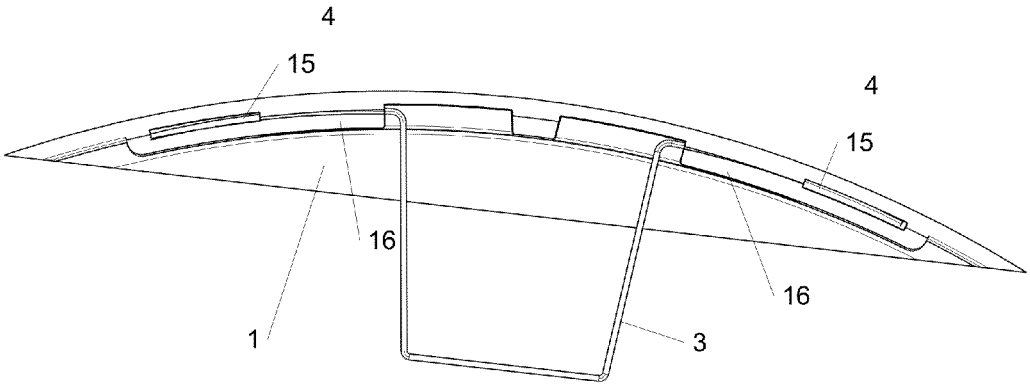
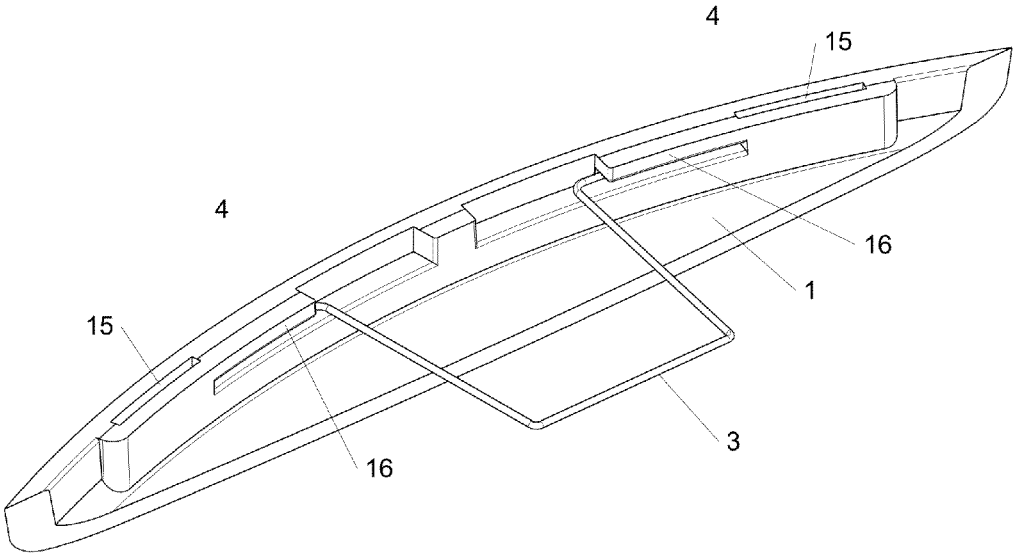
FIG 1D

LIGHT REFLECTOR CONE MOUNTING APPARATUS

RELATED APPLICATIONS

This application is a continuation-in-part of U.S. non-provisional patent application Ser. No. 13/758,222 entitled "Cone Mounting, Support, or Gasket Apparatus" filed Feb. 4, 2013, and claims the benefit of the following United States provisional and non-provisional patent applications, the contents of which are incorporated herein by reference in their entirety, as if set forth in full: U.S. Provisional Patent Application No. 61/632,310 entitled "Light Reflector Cone" filed Jan. 23, 2012, and U.S. Provisional Patent Application No. 61/633,858 entitled "Light Reflector Cone" filed Feb. 21, 2012, and Provisional Patent Application No. 61/687,374 entitled "Light Reflector Cone" filed Apr. 25, 2012, and U.S. Provisional Patent Application No. 61/742,046 entitled "Light Reflector Cone" filed Aug. 2, 2012 and U.S. non-provisional patent application Ser. No. 13/718,013 entitled "Light Reflector Cone", filed Dec. 18, 2012, 2012 and U.S. non-provisional patent application Ser. No. 13/758,222 entitled "Cone Mounting, Support, or Gasket Apparatus" filed Feb. 4, 2013.

TECHNICAL FIELD

This invention generally relates to both light reflectors as described in previously listed patent applications, and mechanical fastening, support or gasket apparatuses or devices.

BACKGROUND

Example embodiments of light reflectors comprising reflecting cones made from one or more layers of optical films, which may be suitable for use in recessed light fixtures, are described in U.S. patent application Ser. No. 13/718,013, and filed Dec. 18, 2012. Typical example embodiments may comprise one or more layers of optical films, which may be configured into a cone shape with a smaller top opening through which a light source may protrude through, and a larger bottom opening, which may serve as the optical aperture of the light reflector.

Example embodiments of cone mounting or support apparatuses, which may be suitable for use with recessed light fixtures, are described in U.S. patent application Ser. No. 13/758,222 entitled "Cone Mounting, Support, or Gasket Apparatus" filed Feb. 4, 2013. Certain embodiments of the disclosed technology may provide mounting or support apparatus that may attach to example embodiments of light reflector cones, and which may be configured to retrofit over top of recessed light fixture reflector trims. Certain other embodiments of the previously disclosed technology may provide mounting or support apparatus that may attach to example embodiments of light reflector cones, and which may be configured to attach directly to recessed light fixture housings with torsion clips.

BRIEF SUMMARY

One example implementation of the disclosed technology is directed to a light reflector cone mounting apparatus that is configured to attach to a light reflector trim, and comprises an outer perimeter edge configured with two or more perimeter clip mounting features. Perimeter clips can be engaged in each of the two or more perimeter clip mounting features, wherein each perimeter clip is configured to engage between the light reflector trim and a ceiling surface, thereby attaching the light reflector cone mounting apparatus to the light reflector trim.

Another example implementation of the disclosed technology is directed to a dual configuration light reflector cone mounting apparatus that can be configured to attach to either a light reflector trim or a light fixture housing. It comprises an outer perimeter edge configured with two or more perimeter clip mounting features. Perimeter clips can be engaged in each of the two or more perimeter clip mounting features, wherein each perimeter clip is configured to engage between a light reflector trim and a ceiling surface, thereby attaching the light reflector cone mounting apparatus to the light reflector trim. An inner edge is configured with two torsion clip-mounting features wherein a torsion clip can be engaged in each of the two torsion clip-mounting features. Each torsion clip is configured to attach to a light fixture housing, thereby attaching the light reflector cone mounting apparatus to the light fixture housing.

Another example implementation of the disclosed technology is directed to a light reflector cone mounting apparatus that can be configured to attach to a light fixture housing. It comprises an inner edge configured with two torsion clip-mounting features, wherein a torsion clip can be engaged in each of the two torsion clip mounting features. Each torsion clip is configured to attach to a light fixture housing, thereby attaching the light reflector cone mounting apparatus to the light fixture housing.

BRIEF DESCRIPTION OF THE FIGURES

FIG. 1C shows cutaway top view of an example embodiment of light reflector cone mounting apparatus with an example perimeter clip attached.

FIG. 1D shows cutaway perspective view of an example embodiment of light reflector cone mounting apparatus with an example perimeter clip attached.

DETAILED DESCRIPTION

Embodiments of the disclosed technology will be described more fully hereinafter with reference to the accompanying drawings in which embodiments of the disclosed technology are shown. This disclosed technology, however, may be embodied in many different forms and should not be construed as limited to the embodiments set forth herein; rather, these embodiments are provided so that this disclosure will be thorough and complete, and will fully convey the scope of the disclosed technology to those skilled in the art.

One common type of light reflector trim for recessed downlights may be a partial cone type that may be designed for use with reflector style lamps. They typically may be configured in two pieces, the main reflector cone, and a trim ring that engages the ceiling surface. They may be configured as a one-piece unit as well. The term "light reflector trim" or "reflector trim" will herein refer to the entire light reflector assembly. Light reflector trims may be typically attach to a recessed light fixture housing with two springs, wherein the spring tension created pulls the light reflector trim towards the inner housing, thereby holding the reflector trim ring securely against the ceiling surface.

Figure 1A:
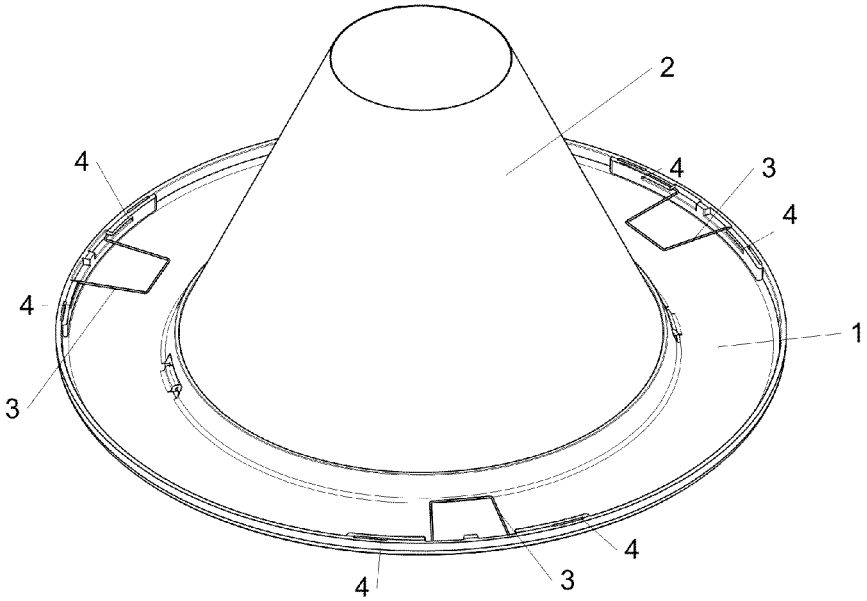
FIG. 1A shows a perspective view of an example embodiment of light reflector cone mounting apparatus with example perimeter clips and light reflector cone attached.
Figure 1B:
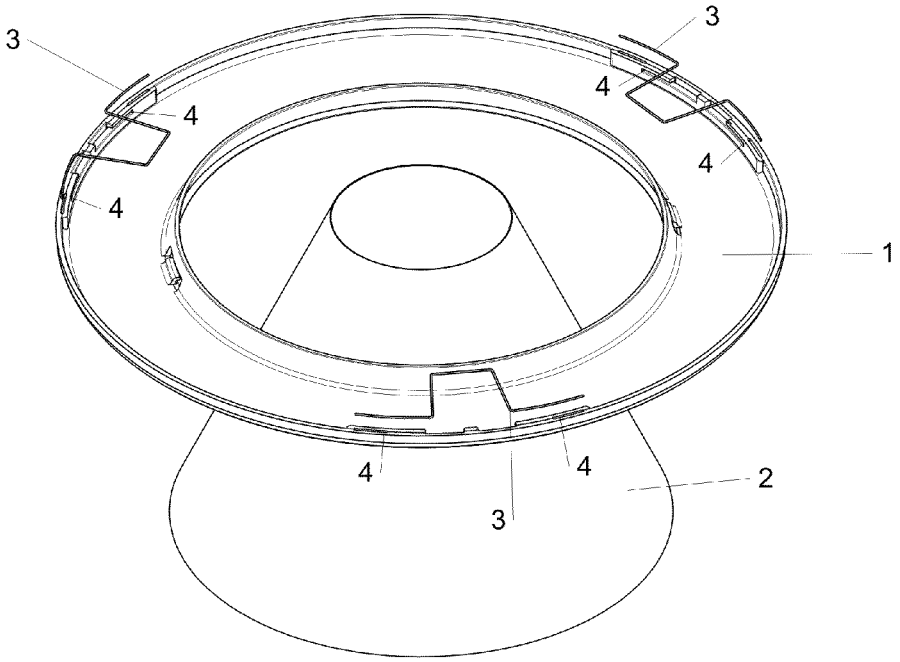
FIG. 1B shows an exploded perspective view of the example embodiment of light reflector cone mounting apparatus with example perimeter clips and light reflector cone attached as depicted in FIG. 1A.

FIG. 1A, shows an example embodiment of a dual configuration light reflector cone mounting apparatus which may be configured to attach to a light reflector trim, or directly to a light fixture housing. The ability to be configured in both ways may have significant cost advantages. FIG. 1B shows an exploded perspective view of the same.

Light reflector cone 2 may be an example embodiment of light reflector cone previously disclosed, and may be mounted in light reflector cone mounting apparatus 1 (herein referred to as "cone mount"). Perimeter clips 3 may be configured from spring wire, and may engage clip-retaining features 4. Each end of a perimeter clip 3 may be engaged in two opposing clip-retaining features 4.

FIGS. 1C and 1D shows a close up view of one of the three clip-retaining features 4. Clip-retaining features 4 may be configured into the outer perimeter edge of cone mount 1. In an example embodiment, a clip-retaining feature 4 may comprise a ledge 16 and a slot 15 as shown, wherein the each end portion of perimeter clip 3 may be inserted under ledge 16 and engage inside slot 15. Perimeter clips 3 may be configured such that each end portion is sufficiently long enough that once inserted as described, the bend in the wire on each end portion will be disposed outside ledge 16, thus allowing the perimeter clip 3 to rotate to a vertical position. Clip-retaining features 4 may be configured with a ledge 16 and slot 15 arrangement as shown in applications where cone mount 1 is fabricated using injection molding methods. Although simple holes may be adequate to retain the ends of retrofit clip 3, simple holes configured into the outer perimeter edge of cone mount 1 may either create unjustified mold tooling costs, or may not be possible at all using injection molding methods. Simple holes may be utilized if the fabrication methods of cone mount 1 makes that possible.

Figure 2A:
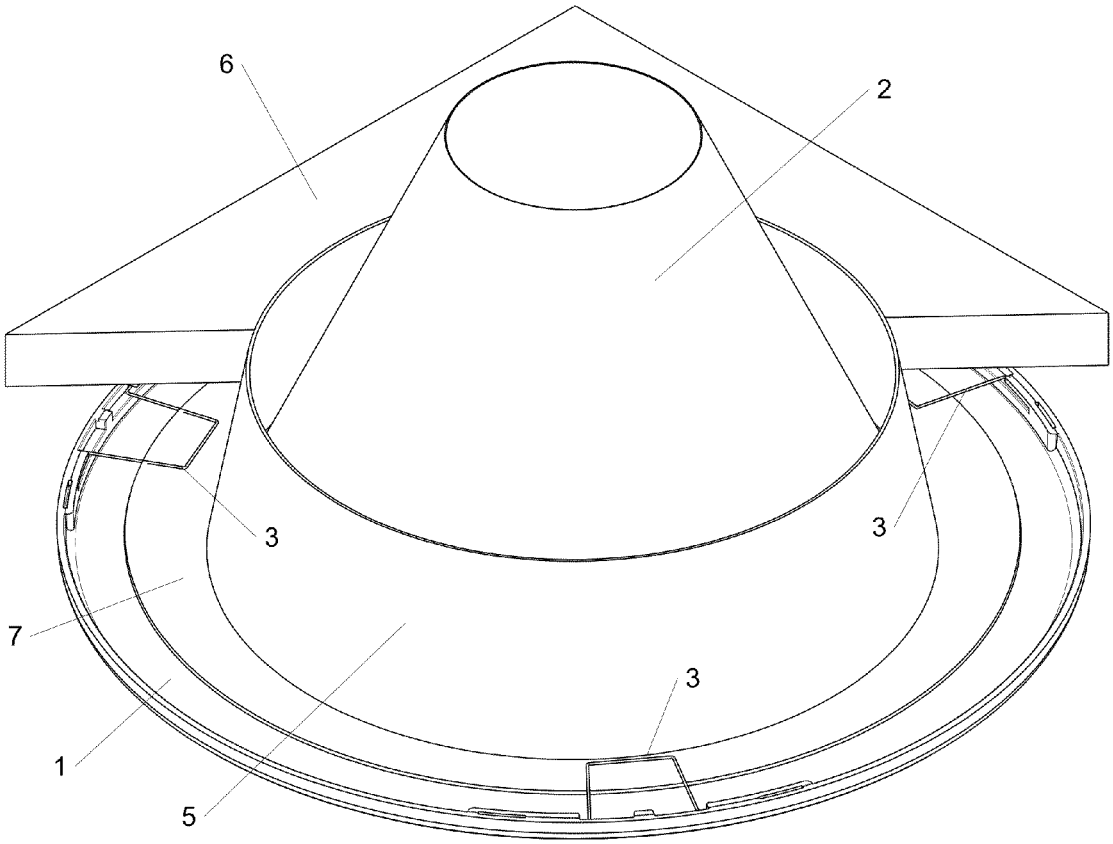
FIG. 2A shows a perspective view of an example embodiment of light reflector cone mounting apparatus with example perimeter clips and light reflector cone attached, that is retrofitted over a recessed light reflector trim and mounted in a ceiling.

In FIG. 2A, a typical commercial partial cone light reflector trim 5 is shown mounted in a cutaway view of ceiling 6. The light fixture housing that the reflector 5 would normally attach to, as well as retaining springs holding the light reflector trim to the housing under tension as previously discussed, are not shown for simplification. The reflector trim 5 may be pulled away from the ceiling a sufficient distance to allow one of the perimeter clips 3 to be inserted between the ceiling surface 6 and the light reflector trim 5. Once the reflector trim 5 is released, the perimeter clip may be securely sandwiched between the ceiling 6 and the reflector trim 5. The remaining perimeter clips may be inserted and engaged in a similar fashion.

Figure 2B:
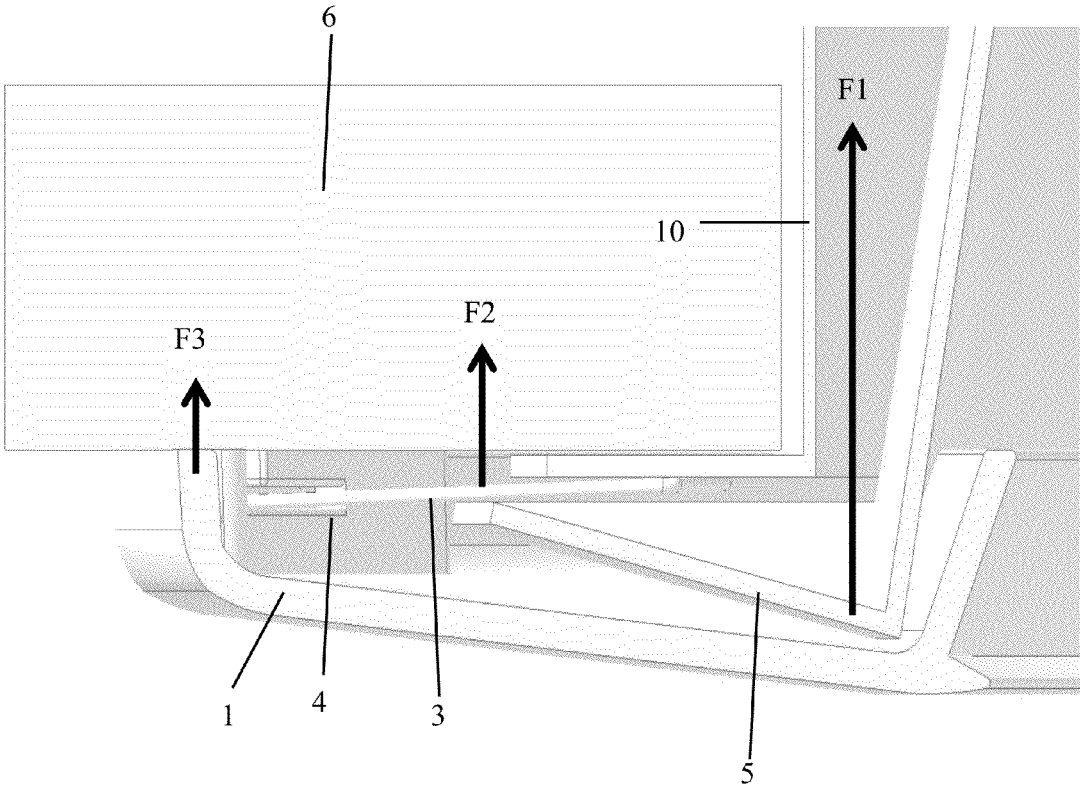
FIG. 2B shows side cutaway view of an example embodiment of light reflector cone mounting apparatus with example perimeter clips and light reflector cone attached, that is retrofitted over a recessed light reflector trim and mounted in a ceiling.

FIG. 2B shows a close-up cutaway of the installed assembly. Reflector trim 5 may be held against ceiling 6 under tension from retaining springs attached to housing 10 as previously described. This force may be represented by arrow F1. Force F1 acting on reflector trim 5, may force perimeter clip 3 towards the ceiling 6, and this force may be represented by arrow F2. By virtue of the fact that perimeter clip 3 engages clip-retaining feature 4, and clip-retaining feature 4 is disposed below the top edge of cone mount 1, force F3 may thereby be created, which may serve to hold the cone mount 1 securely against the ceiling surface 6.

Perimeter clip 3 may be configured from any suitable thickness of spring wire that may be suitable for the application, for example 0.02" thick wire may be sufficiently thick for many applications. The size and shape of perimeter clips may be configured to adequately engage all anticipated sizes of reflector trims. The trapezoidal shape as shown may be suitable, however many alternate shapes and sizes may also be utilized.

Example embodiments may be configured with two sets of perimeter clip mounting features and two perimeter clips or four sets of perimeter clip mounting features and four perimeter clips. Both configurations may achieve acceptable results. However, due to variations of the flatness of ceiling surfaces, and the variation in how perpendicular the fixture housing was installed in the ceiling, three sets of perimeter clip mounting features and three perimeter clips may achieve a fit with less gaps between the ceiling surface and an example embodiment compared to two.

Although wire clips are shown, other suitable types of clips that may be utilized. For example, the clips may be configured from flat material that exhibits some degree of elasticity, such as flat spring metal or plastic strips, or non-elastic materials providing the clip may be configured to rotate. The main requirement of the configuration of clip used may be the requirement that the clip be able to rotate or bend sufficiently to allow insertion between a light reflector trim and a ceiling surface.

The other most common light reflector trim type may be a full cone reflector trim that may typically attach to a recessed light fixture housing with torsion spring clips. A similar method of attaching example embodiments of cone mount to these full cone type reflector trims may be utilized as previously described. However, since the full cone reflector trims are attached with torsion clips, they may be pulled away from the ceiling surface, after which they may typically stay in a static position, and not be pulled back into the fixture housing as they would if they were configured with extension springs. Accordingly, if the full cone reflector trim is pulled away from the ceiling surface, it may be quite easy to place an example embodiment of cone mount over the reflector trim, rotate or bend and engage the perimeter clips over the reflector trim, and subsequently push the assembly back into the ceiling.

In a previous example embodiment, the cone mount may be attached to a light reflector trim using adhesive putty. Example embodiments of the disclosed technology may have several advantages over that method:

1) It may be a more secure method of attachment that will not change over time or with varying temperature conditions.
2) It may allow the cone mount to be held against a ceiling surface under tension, thereby lessening any possible gaps.
3) It may have a lower cost of manufacture.
4) It may be easier to install.

In applications where it is desired that an example embodiment function as a stand-alone light reflector trim, and not as a retrofit over an existing light reflector trim, it may be attached directly to a light fixture housing.

Figure 3A:
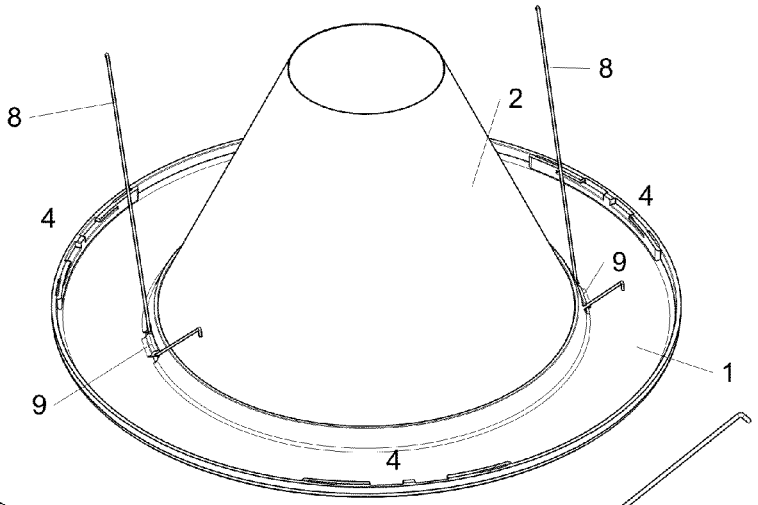
FIG. 3A shows a perspective view of an example embodiment of light reflector cone mounting apparatus with example removable torsion clips and light reflector cone attached.
Figure 3B:
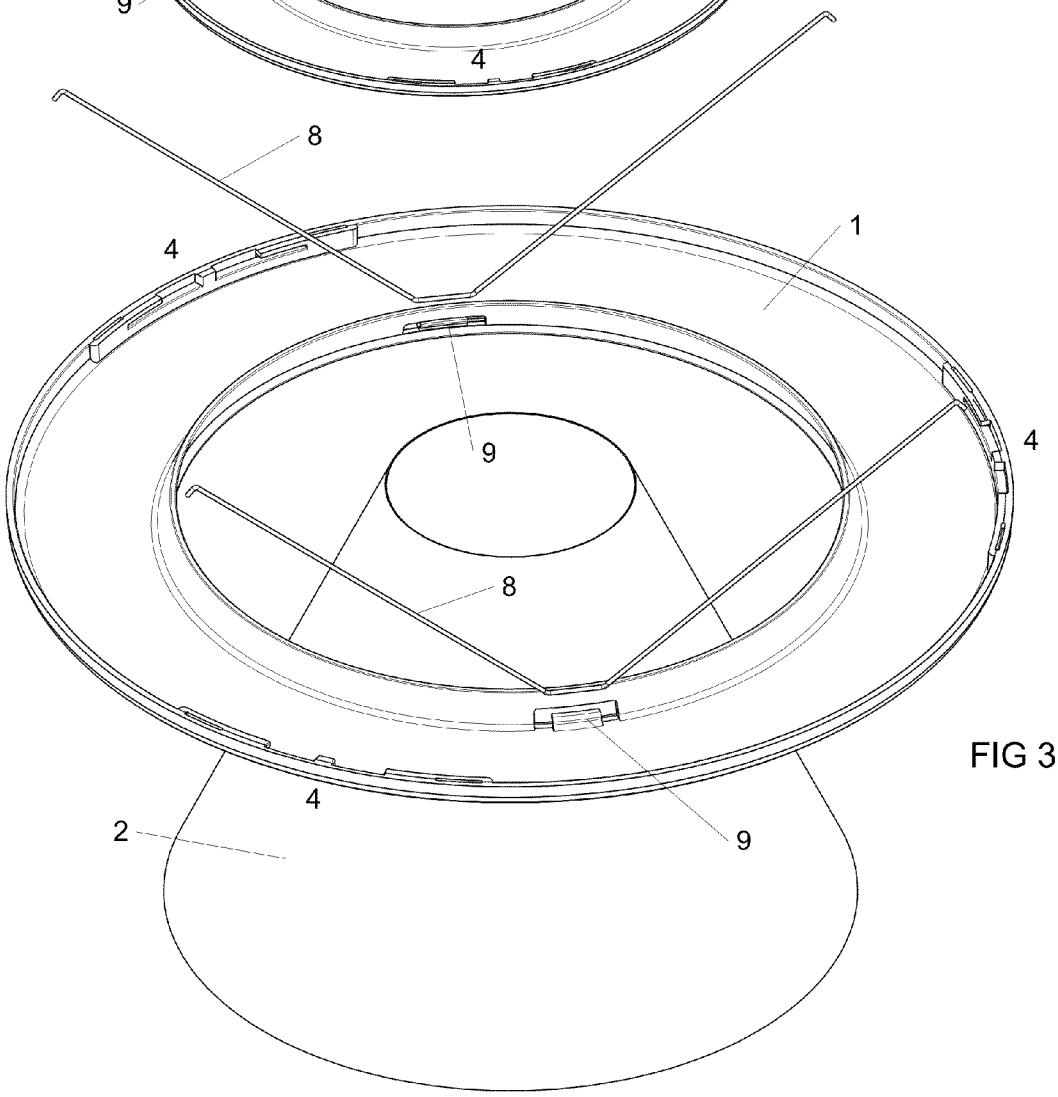
FIG. 3B shows an exploded perspective view of an example embodiment of light reflector cone mounting apparatus with example removable torsion clips and light reflector cone attached, as shown in FIG. 3A.
Figure 3C:
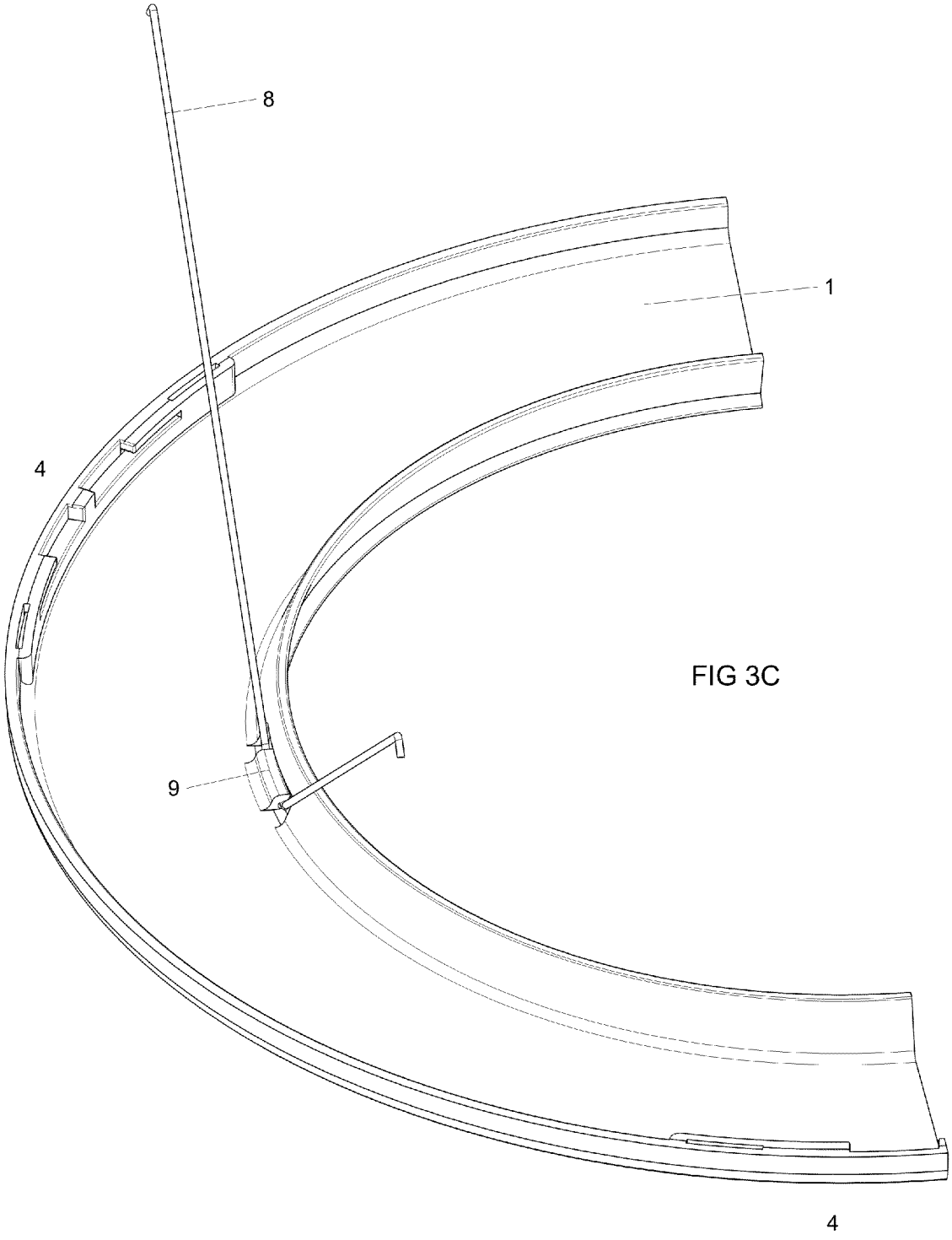
FIG. 3C shows a perspective cutaway view of an example embodiment of light reflector cone mounting apparatus with example removable torsion clips attached.

FIG. 3A shows an example embodiment of cone mount 1 with a reflector cone 2 attached. In an example embodiment, the cone mount has perimeter clip-mounting features 4 as previously discussed, and also has two torsion clip-mounting features 9, which may enable torsion clips 8 to engage therein, and which may allow the cone mount 1 to attach to a recessed light fixture housing. FIG. 3B shows an exploded view of FIG. 3A. Torsion clip-mounting features 9 may comprise any suitable clasp configuration that will suitably engage torsion clips 8 between the clasp and reflector cone 2, and which may allow the torsion clip to be removable. The torsion clips 8 may be configured from spring wire.

Full cone reflector trims may typically attach to a recessed light fixture housing with torsion spring clips. Since reflector trims may be relatively heavy, and the consequences of the reflector trim accidentally detaching from the housing and falling may be significant, the clips may typically be configured with relatively heavy gauge wire in order to create an adequately secure means of attachment of the reflector trim to the housing. The clips may be typically attached to the reflector trim with rivets, crimping or other methods to create a secure attachments of the clip to reflector trim, whereby the clip may be permanently fastened to the reflector trim, and may not be removable. Typical reflector trims have non-removable torsion clips, preventing the reflector trims from nesting inside each other. Accordingly, each reflector trim must be packaged in its own separate package or box, which increases packaging costs, shipping and handling costs, and takes up significantly more storage space. Example embodiments of 6" cone mounts with torsion clips detached may be stack as high as 20 or more in a box or package 8" tall, creating a significant cost advantage.

Example embodiments of the disclosed technology have been described as being configurable either for attachment to a light reflector trim, or for attachment directly to a light fixture housing. However, example embodiments may be configured solely for either method of attachment, and need not be dually configurable. Example embodiments that are configured solely for attachment to a light fixture housing do not need to incorporate the outer perimeter clip mounting features, nor do they need to be able to fit over top of all anticipated sizes of light reflector trims. Accordingly, the overall design may be made much thinner, and may be configured to visually look like typical light reflector trims when installed in a ceiling.

One example implementation of the disclosed technology is directed to a light reflector cone mounting apparatus that is configured to attach to a light reflector trim, and comprises an outer perimeter edge configured with two or more perimeter clip mounting features. Perimeter clips can be engaged in each of the two or more perimeter clip mounting features, wherein each perimeter clip is configured to engage between the light reflector trim and a ceiling surface, thereby attaching the light reflector cone mounting apparatus to the light reflector trim.

In an example implementation, the perimeter clips are comprised of spring wire.

In an example implementation, the perimeter clips are comprised of flat spring metal.

In an example implementation, the perimeter clips are comprised of flat semi flexible material.

In an example implementation, the perimeter clips are comprised of a flat rigid material.

In an example implementation, each perimeter clip-mounting feature is characterized by a slot and a ledge, wherein the end portion of each perimeter clip is engaged inside the slot and underneath the ledge.

In an example implementation, each perimeter clip-mounting feature is characterized by a hole configured to engage a portion of a clip.

Another example implementation of the disclosed technology is directed to a dual configuration light reflector cone mounting apparatus that can be configured to attach to either a light reflector trim or a light fixture housing. It comprises an outer perimeter edge configured with two or more perimeter clip mounting features. Perimeter clips can be engaged in each of the two or more perimeter clip mounting features, wherein each perimeter clip is configured to engage between a light reflector trim and a ceiling surface, thereby attaching the light reflector cone mounting apparatus to the light reflector trim. An inner edge is configured with two torsion clip-mounting features wherein a torsion clip can be engaged in each of the two torsion clip-mounting features. Each torsion clip is configured to attach to a light fixture housing, thereby attaching the light reflector cone mounting apparatus to the light fixture housing.

In an example implementation, the torsion clips are comprised of spring wire.

In an example implementation, both torsion clips are removable from the dual configuration light reflector cone mounting apparatus.

In an example implementation, the two torsion clip mounting features comprise clasps configured to engage the two torsion springs, and wherein the two torsion clips may be disengaged from the clasps.

In an example implementation, the perimeter clips are comprised of spring wire.

In an example implementation, the perimeter clips are comprised of flat spring metal.

In an example implementation, the perimeter clips are comprised of flat semi flexible material.

In an example implementation, the perimeter clips are comprised of a flat rigid material.

In an example implementation, each perimeter clip-mounting feature is characterized by a slot and a ledge, wherein the end portion of each perimeter clip is engaged inside the slot and underneath the ledge.

In an example implementation, each perimeter clip-mounting feature is characterized by a hole configured to engage a portion of a perimeter clip.

Another example implementation of the disclosed technology is directed to a light reflector cone mounting apparatus that can be configured to attach to a light fixture housing. It comprises an inner edge configured with two torsion clip-mounting features, wherein a torsion clip can be engaged in each of the two torsion clip-mounting features. Each torsion clip is configured to attach to a light fixture housing, thereby attaching the light reflector cone mounting apparatus to the light fixture housing.

In an example implementation, both torsion clips are removable from the light reflector cone mounting apparatus.

In an example implementation, the two torsion clip-mounting features comprise clasps configured to engage the two torsion clips, and wherein the two torsion clips may be disengaged from the clasps.

I claim:

1. A light reflector cone mounting apparatus configured to attach to a light reflector trim comprising:

an outer perimeter edge configured with two or more perimeter clip-mounting features, wherein perimeter clips can be engaged in each of the two or more perimeter clip-mounting features, wherein each perimeter clip is configured to engage between the light reflector trim and a ceiling surface thereby attaching the light reflector cone mounting apparatus to the light reflector trim.

2. The light reflector cone mounting apparatus of claim 1, wherein the perimeter clips are comprised of spring wire.

3. The light reflector cone mounting apparatus of claim 1, wherein the perimeter clips are comprised of flat spring metal.

4. The light reflector cone mounting apparatus of claim 1, wherein the perimeter clips are comprised of flat semi flexible material.

5. The light reflector cone mounting apparatus of claim 1, wherein the perimeter clips are comprised of a flat rigid material.

6. The light reflector cone mounting apparatus of claim 1, wherein each perimeter clip-mounting feature is characterized by a slot and a ledge, wherein the end portion of each perimeter clip is engaged inside the slot and underneath the ledge.

7. The light reflector cone mounting apparatus of claim 1, wherein each perimeter clip-mounting feature is characterized by a hole configured to engage a portion of a perimeter clip.

8. A dual configuration light reflector cone mounting apparatus that can be configured to attach to either a light reflector trim or a light fixture housing, comprising:

an outer perimeter edge configured with two or more perimeter clip-mounting features, wherein a perimeter clip can be engaged in each of the two or more perimeter clip-mounting features, and wherein each perimeter clip is configured to engage between a light reflector trim and a ceiling surface, thereby attaching the light reflector cone mounting apparatus to the light reflector trim; and an inner edge configured with two torsion clip-mounting features, wherein a torsion clip can be engaged in each of the two torsion clip-mounting features, wherein each torsion clip is configured to attach to a light fixture housing, thereby attaching the light reflector cone mounting apparatus to the light fixture housing.

9. The dual configuration light reflector cone mounting apparatus of claim 8, wherein the torsion clips are comprised of spring wire.

10. The dual configuration light reflector cone mounting apparatus of claim 8, wherein both torsion clips are removable from the dual configuration light reflector cone mounting apparatus.

11. The dual configuration light reflector cone mounting apparatus of claim 8, wherein the two torsion clip mounting features comprise clasps configured to engage the two torsion springs, and wherein the two torsion clips may be disengaged from the clasps.

12. The dual configuration light reflector cone mounting apparatus of claim 8, wherein the perimeter clips are comprised of spring wire.

13. The dual configuration light reflector cone mounting apparatus of claim 8, wherein the perimeter clips are comprised of flat spring metal.

14. The dual configuration light reflector cone mounting apparatus of claim 8, wherein the perimeter clips are comprised of flat semi flexible material.

15. The dual configuration light reflector cone mounting apparatus of claim 8, wherein the perimeter clips are comprised of a flat rigid material.

16. The dual configuration light reflector cone mounting apparatus of claim 8, wherein each perimeter clip-mounting feature is characterized by a slot and a ledge, wherein the end portion of each perimeter clip is engaged inside the slot and underneath the ledge.

17. The dual configuration light reflector cone mounting apparatus of claim 8, wherein each perimeter clip-mounting feature is characterized by a hole configured to engage a portion of a perimeter clip.

* * * * *